US006260572B1

(12) United States Patent
Wu

(10) Patent No.: US 6,260,572 B1
(45) Date of Patent: Jul. 17, 2001

(54) VALVE-COUPLING DEVICE FOR AN INFLATION DEVICE

(76) Inventor: Scott Wu, No. 2, Lane 187, Hsi Hu Road, Ta Li City, Taichung Hsien (TW)

( * ) Notice: Subject to any disclaimer, the term of this patent is extended or adjusted under 35 U.S.C. 154(b) by 0 days.

(21) Appl. No.: 09/754,272

(22) Filed: Jan. 5, 2001

Related U.S. Application Data

(63) Continuation-in-part of application No. 09/536,793, filed on Mar. 28, 2000, now abandoned.

(51) Int. Cl.[7] ..... F16K 15/20
(52) U.S. Cl. ..... 137/231; 137/223; 137/270
(58) Field of Search ..... 137/231, 223, 137/270

(56) References Cited

U.S. PATENT DOCUMENTS 3,926,205 * 12/1975 Gourlet ..... 137/223
4,276,898 * 7/1981 Ross ..... 137/231
5,749,392 * 5/1998 Glotin ..... 137/231
5,762,095 * 6/1998 Gapinski et al. ..... 137/223
5,819,781 * 10/1998 Wu ..... 137/231
5,975,109 * 11/1999 Wu ..... 137/231
5,983,920 * 11/1999 Gapinski et al. ..... 137/231
6,073,645 * 6/2000 Wu ..... 137/231
6,076,544 * 6/2000 Pierce ..... 137/223
6,102,063 * 8/2000 Pierce et al. ..... 137/231
6,105,600 * 8/2000 Wang ..... 137/231
6,105,601 * 8/2000 Wang ..... 137/231

* cited by examiner

*Primary Examiner*—John Rivell
*Assistant Examiner*—Meredith H Schoenfeld
(74) *Attorney, Agent, or Firm*—Rosenberg, Klein & Lee

(57) ABSTRACT

A valve-coupling device includes a main body having a first end engaged with a gas output end of an inflating device, a slider slidably received in a second end of the main body, an end cap mounted to the second end of the main body for enclosing the slider, and a switch member including a stem rotatably received in the main body. The stem has an operative portion outside the main body for manual operation. When the switch member is in a first position, the end cap is engageable with the valve of a first type. When the switch member is in a second position, the end cap is engageable with the valve of a second type.

19 Claims, 6 Drawing Sheets

VALVE-COUPLING DEVICE FOR AN INFLATION DEVICE

CROSS REFERENCE TO RELATED APPLICATION

This is a continuation-in-part application of U.S. Patent Application No. 09/536,793 filed on Mar. 28, 2000, which is now abandoned.

BACKGROUND OF THE INVENTION

1. Field of the Invention

The present invention relates to a valve-coupling device for an inflation device, such as a hand air pump, and more particularly to a valve-coupling device that can be used with at least two types of valves.

2. Description of the Related Art

A wide variety of hand air pumps for bicycles have been proposed. In a typical hand air pump for inflating the front fork shock-absorbing device of a bicycle, the valve coupler of the hand air pump is relatively small and thus tends to be disengaged from the valve of the front fork shock-absorbing device, as the hand air pump is pumping high-pressure air into the shock-absorbing device. In addition, the valve coupler of the hand air pump can only be used to engage with a specific type of valves.

The present invention is intended to provide a valve-coupling device that mitigates and/or obviates these problems.

SUMMARY OF THE INVENTION

It is a primary object of the present invention to provide a valve-coupling device for an inflating device to reliably retain the valve-coupling device on the valve of an object to be inflated. In addition, the valve-coupling device includes a switch member such that the valve-coupling device can be used with an American valve or a French valve upon manually switching the switch member.

In a preferred embodiment of the present invention, a valve-coupling device is provided for an inflating device with a gas output end. The valve-coupling device comprises:

a main body including a compartment extending transversely with respect to a longitudinal axis of the main body, the main body further including a first receptacle in a first end thereof and a second receptacle in a second end thereof, the first receptacle and the second receptacle being communicated with each other via the compartment, the first end of the main body being adapted to be engaged with a gas output end of an inflating device with the first receptacle being communicated with the gas output end;

a slider including a first end and a second end slidably received in the second receptacle of the main body, the slider further including a longitudinal bore;

an end cap mounted to the second end of the main body for enclosing the first end of the slider, the first end cap including a hole in a first end thereof and a screw hole in a second end thereof, the hole and the screw hole being communicated with each other and the screw hole being communicated with the longitudinal bore of the slider, the screw hole being adapted to be engaged with a valve of an object to be inflated; and a switch member including a stem rotatably received in the compartment of the main body, the stem having an operative portion outside the main body for manual operation, the stem further including a transverse hole, the switch member being pivotable between a first position and a second position;

wherein when the switch member is in the first position, the transverse hole of the stem is not aligned with the first receptacle and the second receptacle of the main body, thereby allowing the screw hole of the end cap to be engaged with the valve of a first type; and wherein when the switch member is in the second position, the transverse hole is aligned with the first receptacle and the second receptacle of the main body, thereby allowing the screw hole of the end cap to be engaged with the valve of a second type, the slider being extended through the transverse hole when the screw hole of the end cap is engaged with the valve of the second type.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
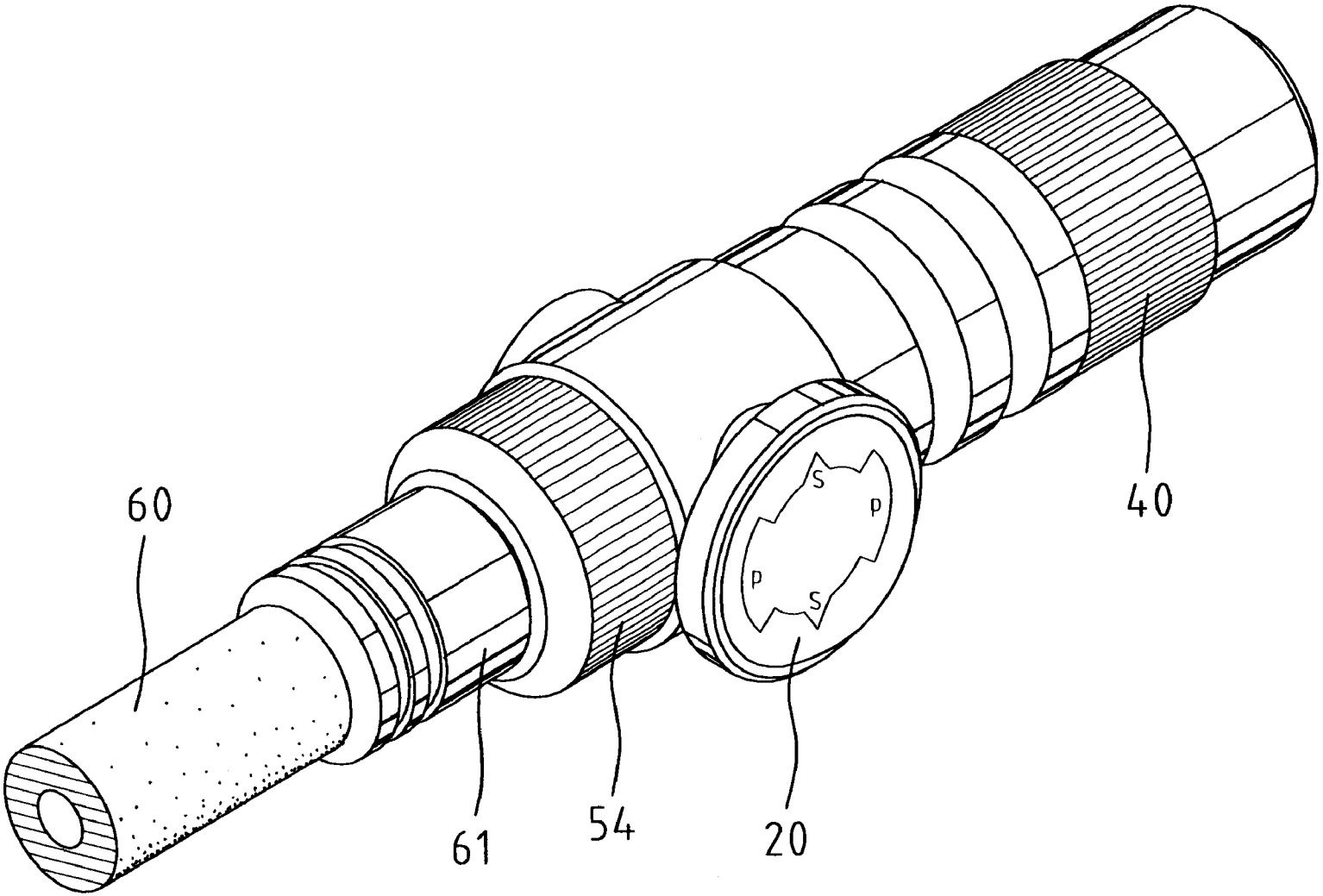
FIG. 1 is a perspective view of a valve-coupling device in accordance with the present invention.
Figure 2:
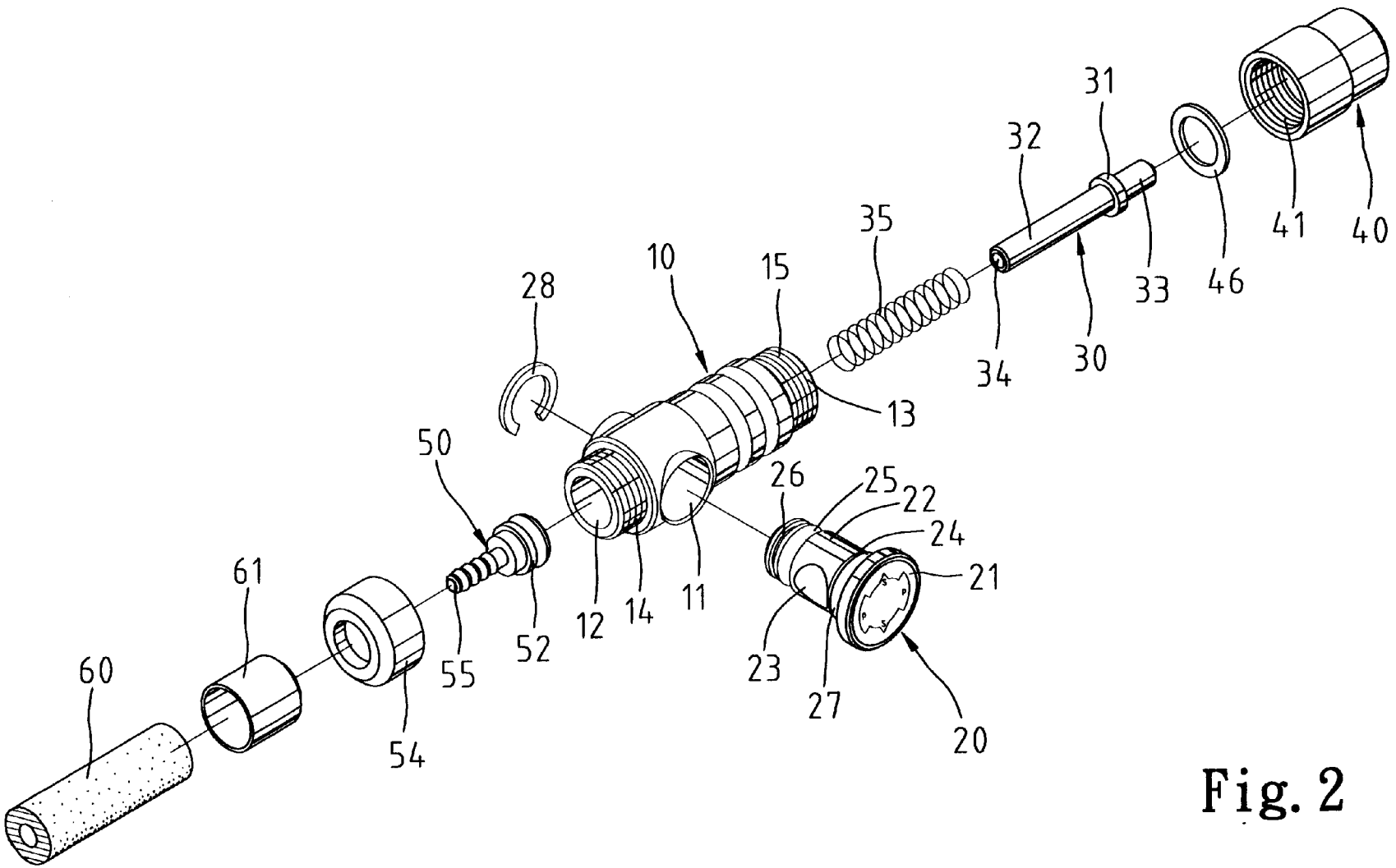
FIG. 2 is an exploded perspective view of the valve-coupling device in accordance with the present invention.
Figure 3:
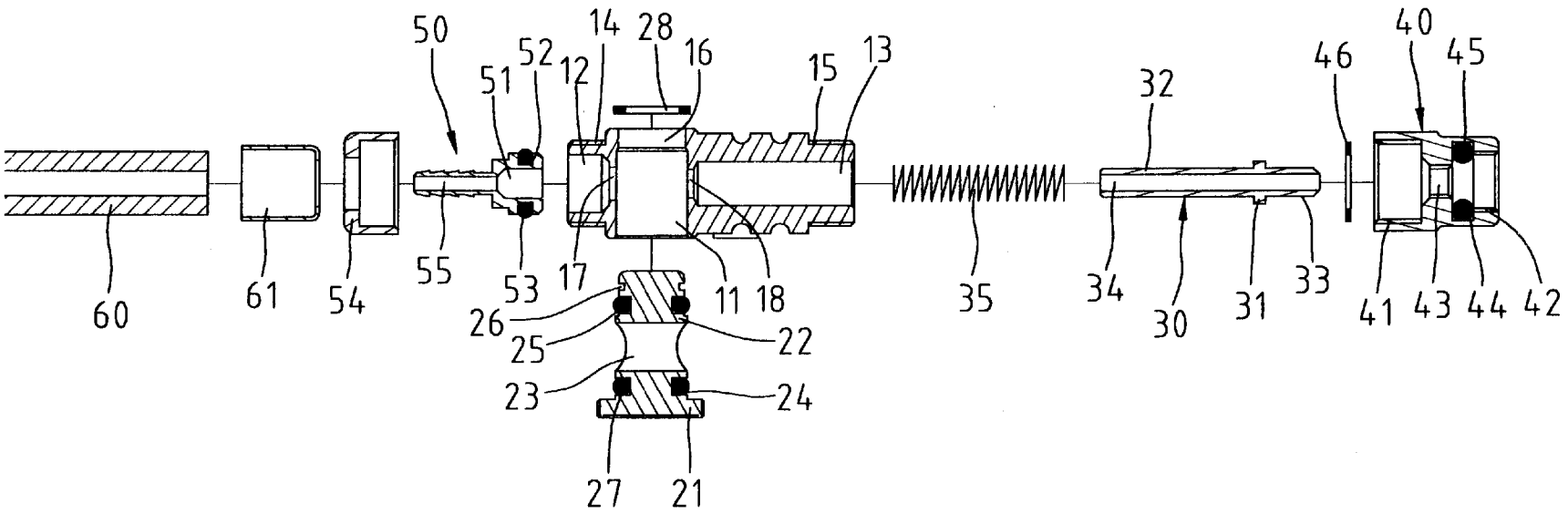
FIG. 3 is an exploded sectional view of the valve-coupling device in accordance with the present invention.

Referring to FIGS. 1 through 6 and initially to FIGS. 1 through 3, a valve-coupling device in accordance with the present invention is mounted to a gas output end 60 of an inflating device (e.g., a hand air pump) by an engaging sleeve 61. The valve-engaging device includes a main body 10 having a compartment 11 that extends transversely with respect to a longitudinal axis of the main body 10. The compartment 11 has a smaller section 16 in a side thereof. The main body 10 further includes a first receptacle 12 in a first end thereof and a second receptacle 13 in a second end thereof. The first receptacle 12 is communicated with the compartment 11 via a passage 17 and the second receptacle 13 is communicated with the compartment 11 via a passage 18. The passages 17 and 18 are communicated with each other and form a portion of an annular passage surrounding the compartment 11. Each of the first end and the second end of the main body 10 includes an outer threading 14, 15.

The valve-coupling device further comprises a switch member 20 comprising a stem 22 with an operative portion 21 formed on a first end thereof. The stem 22 is received in the compartment 11 of the main body 10, which will be described later. An annular groove 24 is defined in the first end of the stem 22 for receiving an O-ring 27. Another O-ring (not labeled) is received in an annular groove 25 defined in the second end of the stem 22. A further annular groove 26 is defined in a distal portion of the second end of the stem 22. The operative portion 21 has an outer end face on which two diametrically opposed marks (such as "P")

and two other diametrically opposed marks (such as "S") located at an angle of 90 degrees with respect to the first-mentioned marks are provided.

Figure 4:
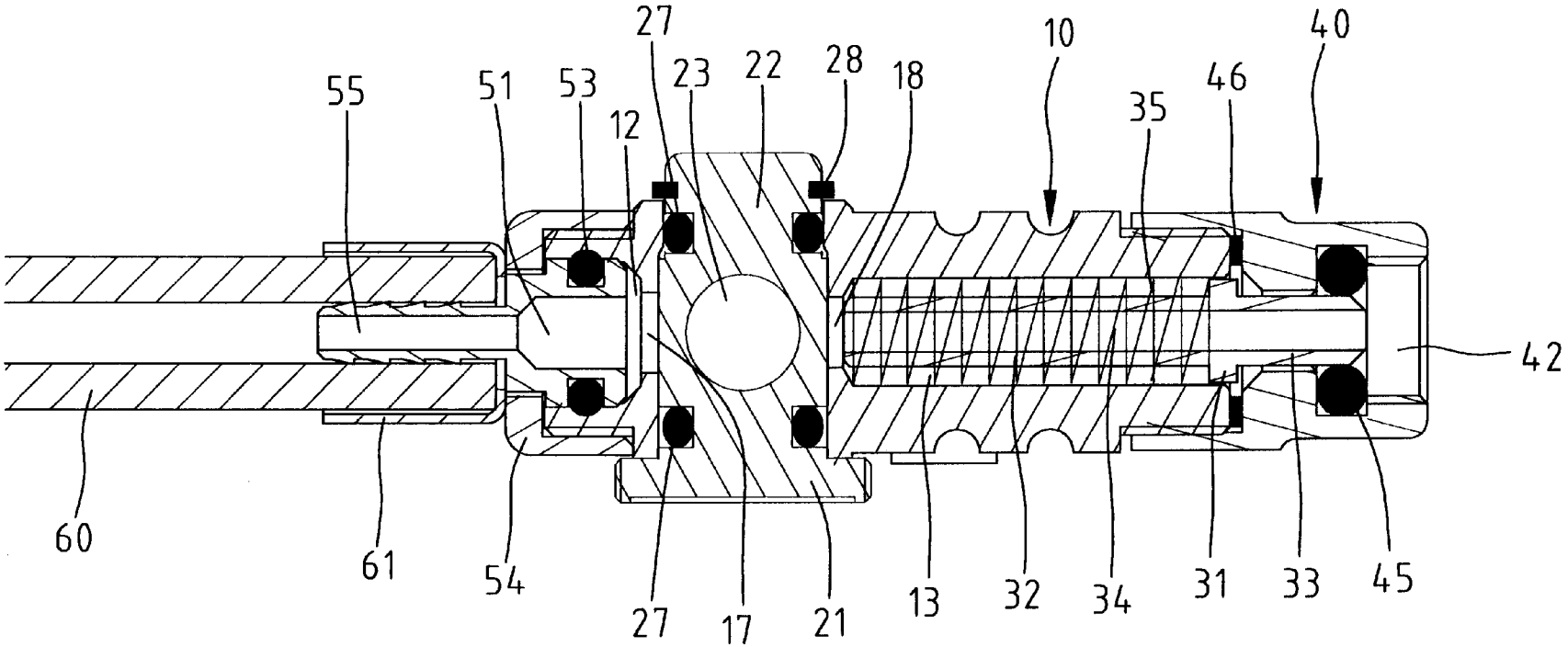
FIG. 4 is a sectional view of the valve-coupling device in accordance with the present invention.

A slider 30 is mounted in the second receptacle 13 of the main body 10 and includes a longitudinal bore 34 and a flange 31. As illustrated in FIG. 4, a first end 33 of the slider 30 is outside the main body 10 and a second end 32 of the slider 30 is received in the second receptacle 13 of the main body 10 with an elastic element 35 mounting around the second end 32 of the slider 30. It is noted that an end of the elastic element 35 is attached to the flange 31 and the other end of the elastic element 35 is attached to an inner end wall defining the second receptacle 13.

An end cap 40 is provided to enclose the first end of the slider 30. In this embodiment, the slider 40 comprises a screw hole 41 in a first end thereof for engaging with the outer threading 15 of the main body 10. As illustrated in FIG. 4, a washer 46 is mounted between an end face of the second end of the main body 10 and an inner end face of the screw hole 41 of the end cap 40. The end cap 40 further includes a screw hole 42 in a second end thereof. An inner annular groove 44 is defined in the second end of the end cap 40 for receiving an O-ring 45. The screw holes 41 and 42 are communicated with each other via a passage 43.

An adaptor 50 is mounted in the first receptacle 12 of the main body 10 for coupling the first end of the main body 10 to the gas output end 60 via the engaging sleeve 61. In this embodiment, the adaptor 50 is received in the first receptacle 12 of the main body 10 and includes an engaging tube (not labeled) extending from a side thereof. An O-ring 53 mounted in an annular groove 52 defined in an outer periphery of the adaptor 50 for providing a sealing effect. The engaging tube (not labeled) is securely engaged in the gas output end 60 (in the form of a tube) such that gas (including air or other suitable gas) from the gas source enters a longitudinal passage 55 of the adaptor 50. An end cap 54 is mounted around the first end of the main body 10 by threading engagement of an inner threading (not labeled) of the end cap 54 with the outer threading 14 of the main body 10.

In assembly, as illustrated in FIGS. 3 and 4, the stem 22 of the switch member 20 is inserted through the compartment 11 of the main body 10. A C-clip 28 is mounted in the annular groove 26 in the distal end of the stem 22 that extends beyond the compartment 16. The elastic element 35 is mounted around the second end of the slide 32 which is then placed into the second receptacle 13 of the main body 10. The washer 46 is mounted in the screw hole 41 of the end cap 40 that is mounted to the main body 10 for enclosing the first end of the slider 30 by means of threading engagement between the outer threading 15 and the screw hole 41. Then, the adaptor 50 is mounted into the first receptacle 12 of the main body 10 and the end cap 54 is threadedly engaged with the outer threading 14 of the main body 10 to retain the adaptor 50 in place. The extension of the adaptor 50 is engaged in the tube 60 that is communicated with a gas source, such as a hand air pump or an automatic inflation device.

Figure 5:
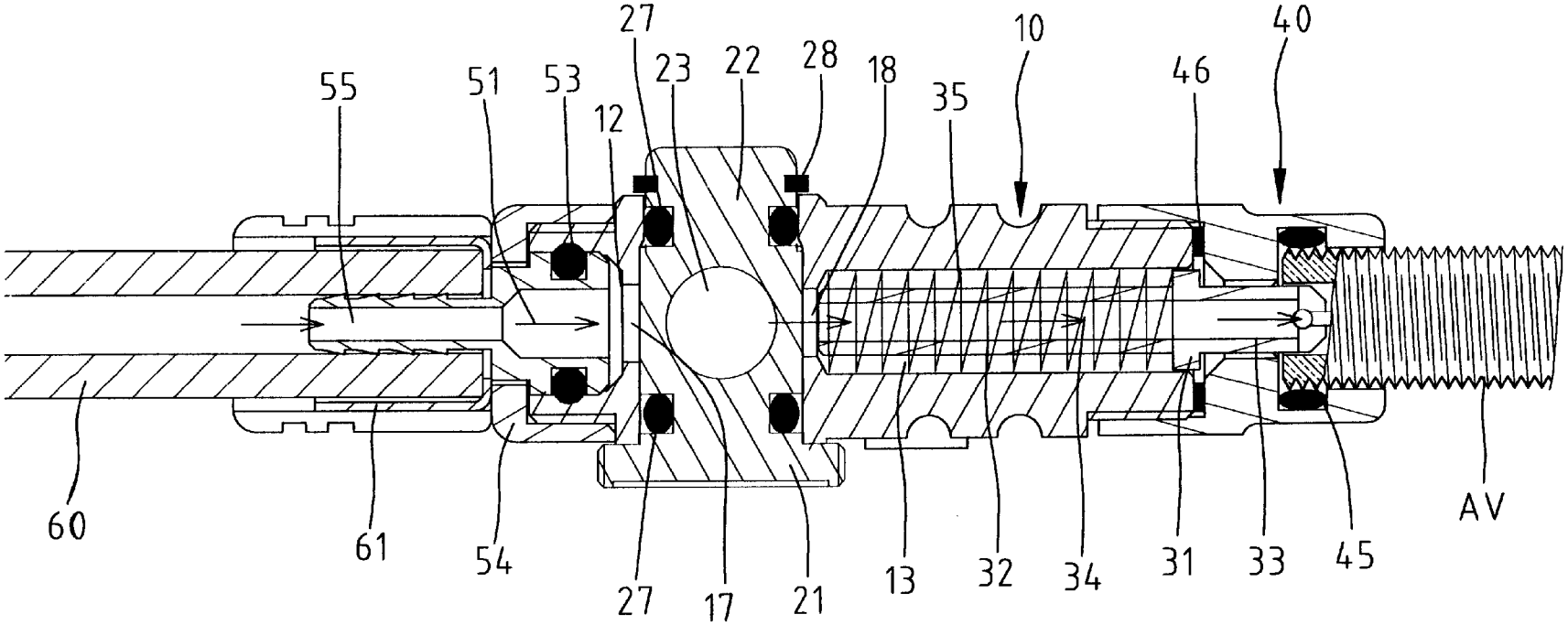
FIG. 5 is a sectional view similar to FIG. 4, wherein the valve-coupling device is coupled with an American valve.

Referring to FIG. 5, when engaging with an American valve AV, the switch member 20 is moved to an "S" position with the "S" at a horizontal position. After the American valve AV is threaded into the screw hole 42 of the end cap 40, the American valve AV is in an optimal contact relationship with the valve-coupling device to achieve the required inflating function. Gas from the source (e.g., a hand air pump) is passable to the American valve AV via the longitudinal passage 55 of the adaptor 55, the annular passage surrounding the compartment 11, and the longitudinal bore 34 of the slider 30. Thus, normal inflation or high-pressure inflation for e.g., a front fork shock-absorbing device of a bicycle can be proceeded without the risk of disengagement of the valve-coupling device from the valve. It is noted that the elastic element 35 is in its natural status when applied to an American valve AV.

Figure 6:
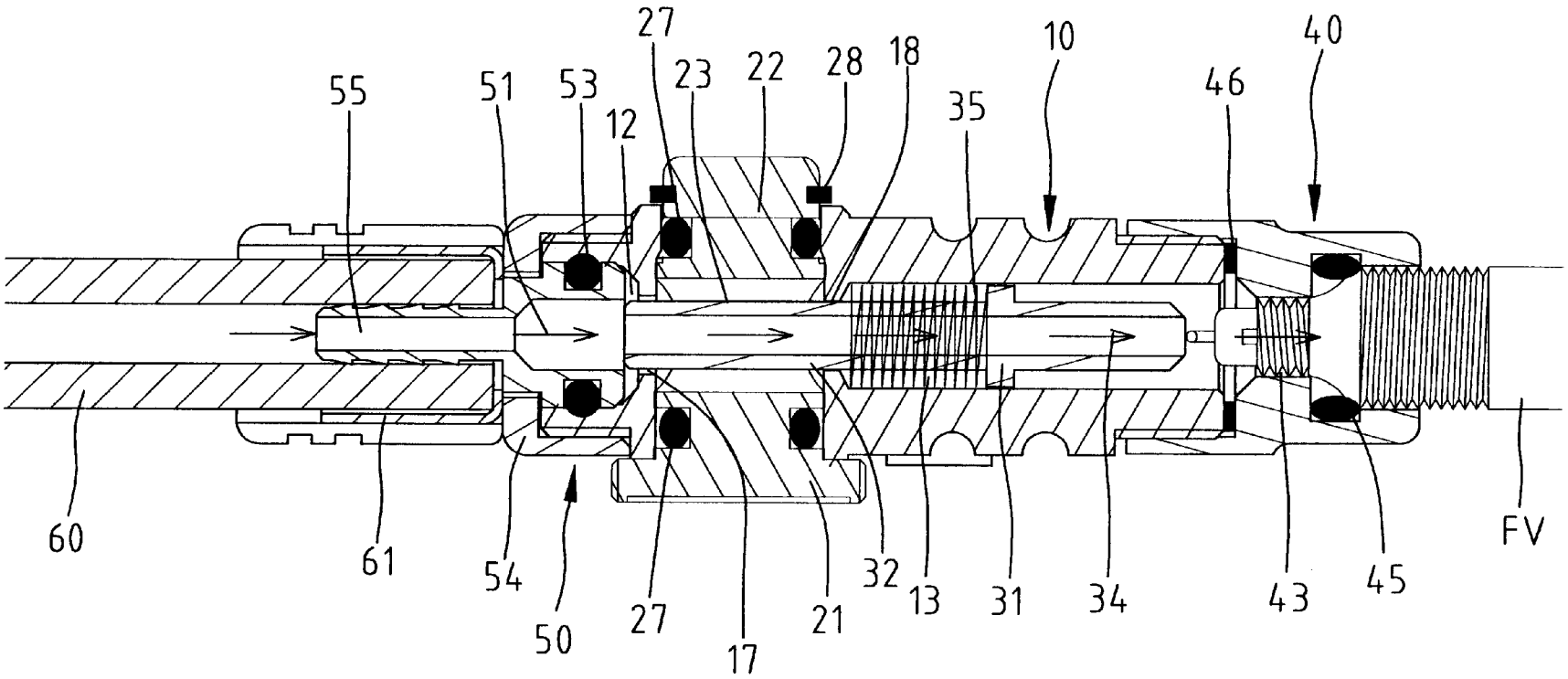
FIG. 6 is a sectional view similar to FIG. 4, wherein the valve-coupling device is coupled with a French valve.

Turning to FIG. 6, when engaging with a French valve FV, the switch member 20 is moved to a "P" position with the "P" at a horizontal position. When the French valve FV is inserted into the end cap 40, a needle (not labeled) of the former moves into a deeper position of the latter (more inward than the situation of American valve AV) and pushes the slider 30 to move away from the end cap 40. Thus, the slider 30 extends through the transverse hole 23 of the switch member 20 and comes in contact with the adaptor 50. The elastic element 35 is compressed and the gas from the source is passable to the French valve FV via the longitudinal passage 55 of the adaptor 50 and the longitudinal bore 34 of the slider 30. Thus, the French valve FV is in an optimal contact relationship with the valve-coupling device to achieve the required inflating function. Again, normal inflation or high-pressure inflation for, e.g., a front fork shock-absorbing device of a bicycle can be proceeded without the risk of disengagement of the valve-coupling device from the valve. It is noted that the elastic element 35 returns the slider 30 to its initial status after the French valve FV is removed.

Although the invention has been explained in relation to its preferred embodiment, it is to be understood that many other possible modifications and variations can be made without departing from the spirit and scope of the invention as hereinafter claimed.

What is claimed is:

1. A valve-coupling device for an inflating device with a gas output end, the valve-coupling device comprising:

a main body including a compartment extending transversely with respect to a longitudinal axis of the main body, the main body further including a first receptacle in a first end thereof and a second receptacle in a second end thereof, the first receptacle and the second receptacle being communicated with each other via the compartment, the first end of the main body being adapted to be engaged with a gas output end of an inflating device with the first receptacle being communicated with the gas output end;

a slider including a first end and a second end slidably received in the second receptacle of the main body, the slider further including a longitudinal bore;

an end cap mounted to the second end of the main body for enclosing the first end of the slider, the first end cap including an end that is communicated with the longitudinal bore of the slider and adapted to be engaged with a valve of an object to be inflated; and a switch member including a stem rotatably received in the compartment of the main body, the stem having an operative portion outside the main body for manual operation, the stem further including a transverse hole, the switch member being pivotable between a first position and a second position;

wherein when the switch member is in the first position, the transverse hole of the stem is not aligned with the first receptacle and the second receptacle of the main body, thereby allowing the end of the end cap to be engaged with the valve of a first type; and wherein when the switch member is in the second position, the transverse hole is aligned with the first receptacle and the second receptacle of the main body, thereby allowing the end of the end cap to be engaged with the valve of a second type, the slider being extended through the transverse hole when the end of the end cap is engaged with the valve of the second type.

2. The valve-coupling device as claimed in claim 1, wherein the valve of the first type is an American valve.

3. The valve-coupling device as claimed in claim 1, wherein the valve of the second type is a French valve.

4. The valve-coupling device as claimed in claim 1, wherein the end of the end cap includes a screw hole.

5. The valve-coupling device as claimed in claim 1, further comprising an elastic element mounted in the second receptacle for biasing the slider to the first position.

6. The valve-coupling device as claimed in claim 5, wherein the slider includes a flange, the elastic element including a first end attached to the flange and a second end attached to an inner end wall defining the second receptacle.

7. The valve-coupling device as claimed in claim 1, further comprising an adaptor for sealingly coupling the first end of the main body to the gas output end of the inflation device.

8. The valve-coupling device as claimed in claim 7, further comprising a second end cap threadedly engaged around the first end of the main body for enclosing the adaptor.

9. The valve-coupling device as claimed in claim 7, wherein the gas output end of the inflating device includes a tube, the adaptor including an extension securely engaged in the tube, the adaptor including a longitudinal passage communicated with the gas output end.

10. A valve-coupling device for an inflating device with a gas output end, the valve-coupling device comprising:

a main body including a compartment extending transversely with respect to a longitudinal axis of the main body, the main body further including a first receptacle in a first end thereof and a second receptacle in a second end thereof, the first receptacle and the second receptacle being communicated with each other via the compartment, the first end of the main body being adapted to be engaged with a gas output end of an inflating device with the first receptacle being communicated with the gas output end;

a slider including a first end and a second end slidably received in the second receptacle of the main body, the slider further including a longitudinal bore;

an end cap mounted to the second end of the main body for enclosing the first end of the slider, the first end cap including a hole in a first end thereof and a screw hole in a second end thereof, the hole and the screw hole being communicated with each other and the screw hole being communicated with the longitudinal bore of the slider, the screw hole being adapted to be engaged with a valve of an object to be inflated; and a switch member including a stem rotatably received in the compartment of the main body, the stem having an operative portion outside the main body for manual operation, the stem further including a transverse hole, the switch member being pivotable between a first an position and a second position;

wherein when the switch member is in the first position, the transverse hole of the stem is not aligned with the first receptacle and the second receptacle of the main body, thereby allowing the screw hole of the end cap to be engaged with the valve of a first type; and wherein when the switch member is in the second position, the transverse hole is aligned with the first receptacle and the second receptacle of the main body, thereby allowing the screw hole of the end cap to be engaged with the valve of a second type, the slider being extended through the transverse hole when the screw hole of the end cap is engaged with the valve of the second type.

11. The valve-coupling device as claimed in claim 10, wherein the valve of the first type is an American valve.

12. The valve-coupling device as claimed in claim 10, wherein the valve of the second type is a French valve.

13. The valve-coupling device as claimed in claim 10, further comprising an elastic element mounted in the second receptacle for biasing the slider to the first position.

14. The valve-coupling device as claimed in claim 13, wherein the slider includes a flange, the elastic element including a first end attached to the flange and a second end attached to an inner end wall defining the second receptacle.

15. The valve-coupling device as claimed in claim 10, further comprising an adaptor for sealingly coupling the first end of the main body to the gas output end of the inflation device.

16. The valve-coupling device as claimed in claim 15, further comprising a second end cap threadedly engaged around the first end of the main body for enclosing the adaptor.

17. The valve-coupling device as claimed in claim 15, wherein the gas output end of the inflating device includes a tube, the adaptor including an extension securely engaged in the tube, the adaptor including a longitudinal passage communicated with the gas output end.

18. The valve-coupling device as claimed in claim 10, wherein the stem of the switch member includes a distal end extending beyond the main body and having an annular groove for engaging with a C-clip to thereby retain the switch member in place.

19. The valve-coupling device as claimed in claim 10, wherein the second end of the main body includes an outer threading, and wherein the hole of the first end of the end cap is a screw hole for threadedly engaging with the outer threading of the main body.

* * * * *